US006663696B1

(12) United States Patent
Miller et al.

(10) Patent No.: US 6,663,696 B1
(45) Date of Patent: Dec. 16, 2003

(54) EARTH CONDUCTOR FOR EARTHING SYSTEMS

(75) Inventors: Jürgen Miller, Offenbach (DE); Jürgen Scharkowski, Mogendorf (DE); Hans Josef Vogt, Vallendar (DE)

(73) Assignee: Metallgesellschaft AG, Frankfurt am Main (DE)

( * ) Notice: Subject to any disclaimer, the term of this patent is extended or adjusted under 35 U.S.C. 154(b) by 0 days.

(21) Appl. No.: 10/048,090

(22) PCT Filed: Jul. 13, 2000

(86) PCT No.: PCT/EP00/06669

§ 371 (c)(1),
(2), (4) Date: Jun. 7, 2002

(87) PCT Pub. No.: WO01/08804

PCT Pub. Date: Feb. 8, 2001

(30) Foreign Application Priority Data

Jul. 31, 1999 (DE) ..... 199 46 283

(51) Int. Cl.[7] ..... B03C 3/70

(52) U.S. Cl. ..... 96/88; 55/360; 55/DIG. 38; 174/110 AR; 174/110 SR; 174/126.1; 174/126.2

(58) Field of Search ..... 96/88; 55/360, 55/DIG. 38; 174/110 AR, 110 SR, 110 V, 126.1, 126.2

(56) References Cited

U.S. PATENT DOCUMENTS 3,765,154 A * 10/1973 Hardt et al. ..... 96/88
4,088,830 A * 5/1978 Wargin et al. ..... 174/113 R
4,177,047 A 12/1979 Goland ..... 55/DIG. 38
4,578,088 A * 3/1986 Linscheid ..... 95/78
5,006,134 A * 4/1991 Knoll et al. ..... 96/88
5,147,423 A * 9/1992 Richards ..... 96/62
5,405,434 A * 4/1995 Inculet ..... 96/54
5,421,863 A * 6/1995 Rector et al. ..... 96/60
5,458,757 A * 10/1995 MacEdmondson ..... 204/662
5,482,540 A * 1/1996 Trinward et al. ..... 95/57
6,176,902 B1 * 1/2001 Matsubara ..... 96/66
6,221,136 B1 * 4/2001 Liu et al. ..... 96/66

FOREIGN PATENT DOCUMENTS

DE 1231216 * 12/1966
DE 1557162 * 4/1970
DE 4328438 * 9/1994

* cited by examiner

*Primary Examiner*—Richard L. Chiesa
(74) *Attorney, Agent, or Firm*—Norris McLaughlin & Marcus

(57) ABSTRACT

Earth conductor for earthing systems of electrostatic separator, consisting of an electrically conductive core with a plastic or rubber sheath. In order to prevent the passage of liquid, the earth conductor consists of two conductor parts, the conductor parts are connected via a liquid-tight graphite piece, to which sections of the conductor parts are fixed, and the graphite piece and the sections of the conductor parts are embedded in a plastic body.

11 Claims, 1 Drawing Sheet

EARTH CONDUCTOR FOR EARTHING SYSTEMS

This is a 371 of PCT/EP00/06669 filed Jul. 13, 2000 (International filing date).

The invention relates to an earth conductor for earthing systems, in particular of electrostatic separators, such as dry, semi-dry or wet electrostatic filters, consisting of an electrically conductive core with a plastic or rubber sheath.

BACKGROUND OF THE INVENTION

Moist, saturated gases are nowadays widely cleaned using wet electrostatic filters, on the precipitation electrodes of which a liquid film forms under the influence of the electric field and runs off continuously. Any particles of dust present are thereby removed as a suspension. If necessary, an additional system of continuously operating mist nozzles can be provided for gas saturation. The moist atmosphere necessitates the use of earth conductors that are good electrical conductors and are made from corrosion resistant materials in order to ensure that the current is safely conducted away from the electrodes. If the earth conductor should be destroyed, the current is conducted away via plastic parts or via the rubber covering of the filter housing, with the result that not insignificant damage occurs, which may lead to the electrostatic filter systems being shut down for extended periods.

DE-C-12 31 216 describes a wet electrostatic separator for cleaning moist chlorine gas or waste gases containing chlorine gas, which, for conducting away the electrical charge of the conductive liquid collecting in the drainage channels, has wick-like, liquid-absorbing cords or ropes produced using a ceramic substance or from glass fibres and connected to an earth conductor.

DE-C-15 57 162 describes a device for the corrosion resistant earthing of precipitation electrodes made from non-conductive material in wet tubular electrostatic dust separators. The lower part of the precipitation electrode tube is rendered electrically conductive by a paint or coating by means of an electrically conductive material and has an earth conductor wound around it in a loop. The strands of the earth conductor in the loop are separated from one another by a spacer made from non-conductive material.

DE-A-43 28 438 discloses an earth conductor for earthing systems of electrostatic separators which has a core made from carbon, e.g. graphite cords, which is encased with a layer of plastic or rubber and which is said to have high corrosion resistance over long operating periods. On use of earth conductors of this type—even in the case of a reduced pressure prevailing in the housing of the electrostatic filter—the capillary action of the earth conductor means that liquid is drawn out of the housing of the electrostatic filter to the screw connections attaching the earth conductor to the earthing system, where it causes considerable corrosion, which leads to destruction of the screw connections with increasing operating time and thus to damage to and shutdown of the electrostatic separator.

SUMMARY OF THE INVENTION

The object of the present invention is to provide an earth conductor for earthing systems, in particular of electrostatic separators, which is simple to install, which is flexible and chemically resistant, and which prevents escape of liquid from the housing of the electrostatic separator so that corrosion of the contact zone between the earth conductor and the earthing system does not occur.

The use of the earth conductor according to the invention is particularly suitable for tubular electrostatic filters, which consist of a housing with plastic tubes arranged in parallel and vertically therein, with electrodes running in the centre of each tube, each tube being connected at both ends to the corresponding current-side conductor part of the earth conductor.

BRIEF DESCRIPTION OF THE DRAWINGS

The invention is described in greater detail with and by way of example below. In the drawing.

DETAILED DESCRIPTION

Figure 1:
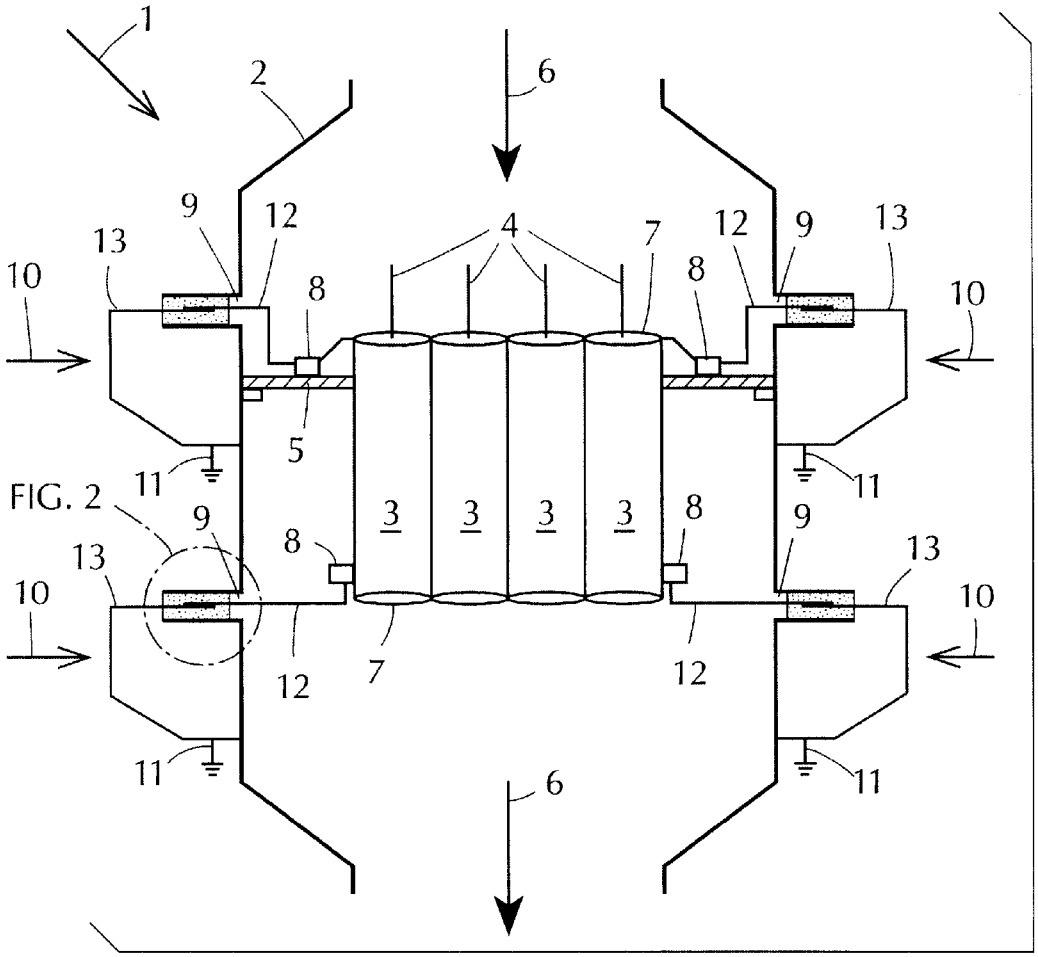
FIG. 1 shows a diagrammatic longitudinal section through a tubular electrostatic filter.
Figure 2:
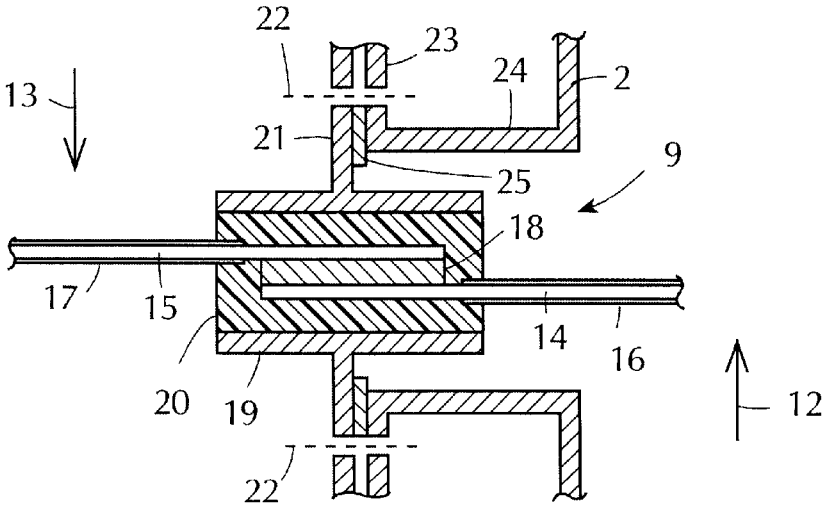
FIG. 2 an enlarged depiction of detail X in FIG. 1.

The tubular electrostatic filter (1) consists of a rubber-covered steel or plastic housing (2) with tubes (3) having a circular cross section arranged in parallel and vertically therein serving as precipitation electrodes, in the centre of which the discharge electrodes (4) are suspended in an insulated manner. The tubes (3), which consist of plastic, are suspended and sealed in a tube carrier base (5) which is arranged in the upper part of the tubular electrostatic filter (1). The lower ends of the tubes are spaced by a grid, which is not shown. The gas direction (6) is generally selected to be from top to bottom. The current transport takes place in the liquid film on the specially prepared surface of the electrically non-conductive plastic of the tubes (3). The plastic tubes (3) serving as precipitation electrodes are thus merely carriers of the conductive liquid film. The electrical current is conducted away from the liquid film to the earthing system from the upper and lower ends of the plastic tubes (3), which are edged at both ends from the outside by an electrically conductive strip (7), which in each case leads to a terminal block (8). From the terminal blocks (8), an earth conductor (10) leads to the earth (11) through corresponding openings (9) in the housing (2) of the tubular electrostatic filter (1). The earth conductor (10) in each case consists of a current source side conductor part and an earth side conductor part (12, 13), which are built up from an electrically conductive core (14, 15) having a rectangular cross section made from graphite fibre braiding with a butyl rubber sheath (16, 17). The two conductor parts (12, 13) are connected by a liquid-tight, cuboid graphite piece (18), which is permanently pressed against unsheathed sections of the cores (14, 15) in a parallel overlapping manner in such a way that the longitudinal axes of the cores (14, 15) run parallel to the longitudinal axis of the graphite piece (18). The graphite piece (18), the unsheathed sections of the cores (14, 15) of the earth conductor (10) which are pressed against it, and the zones of the sheaths (16, 17) adjacent to these sections are embedded in a plastic body (20) cast in a hollow, plastic cylinder (19). The earth conductor (10) is inserted into the opening (9) in the housing (2) of the tubular electrostatic filter (1) via a flange (21) running around the circumference of the hollow cylinder (19) and is bolted, with the insertion of the sealing ring (25), to the corresponding flange (23) of the tube connector (24) installed in the wall of the tubular electrostatic filter (1).

The earth conductor designed in accordance with the invention has high flexibility, is simple to install, and reliably prevents the passage of liquid from the housing of the tubular electrostatic filter to the connecting point with the external earth connection.

What is claimed is:

1. Earth conductor for earthing systems, comprising an electrically conductive core having a plastic or rubber sheath, wherein the earth conductor is comprised of a current source side conductor part and an earth side conductor part, the conductor parts are connected via a liquid-tight graphite piece, to which unsheathed sections of the cores of the conductor parts are fixed, and the graphite piece and the unsheathed sections of the cores of the conductor parts are embedded in a plastic body.

2. Earth conductor according to claim 1, wherein the zones of the sheathing adjacent to the unsheathed sections of the cores of the conductor parts are also embedded in the plastic body.

3. Earth conductor according to claim 1, wherein the graphite piece is cuboidal or cylindrical.

4. Earth conductor according to claim 1, wherein the longitudinal axes of the unsheathed sections of the cores of the conductor parts run parallel to the longitudinal axis of the graphite piece.

5. Earth conductor according to claim 4, wherein the unsheathed sections of the cores of the conductor parts are attached to the graphite piece in a parallel overlapping manner.

6. Earth conductor according to claim 4, wherein the unsheathed sections of the cores of the conductor parts are attached to the graphite piece in a parallel non-overlapping manner.

7. Earth conductor according to claim 6, wherein at least one circular seal is arranged in the region between the ends of the unsheathed sections of the cores of the conductor parts.

8. Earth conductor according to claim 1, wherein the cores of the conductor parts consist of a woven, braided or knitted fabric made from an electrically conductive material.

9. Earth conductor according to claim 1, wherein the plastic body is cast into a hollow cylinder or a hollow prism.

10. A tubular electrostatic filter comprised of a housing with plastic tubes arranged in parallel and vertically, with a discharge electrode running in the centre of each tube, the current being conducted away from the upper and lower end of the plastic tubes to an earth conductor of claim 1 on an earth connection, which is located outside the housing.

11. The earth conductor of claim 8, wherein said electrically conductive material is carbon fibers.

* * * * *